US006260382B1

(12) United States Patent
Ishikawa

(10) Patent No.: US 6,260,382 B1
(45) Date of Patent: Jul. 17, 2001

(54) PIERCED EARRING

(76) Inventor: Hidetoshi Ishikawa, 102 Greenheights, 953-3, Osato-cho, Kou-shi, Yamanashi 400 (JP)

( * ) Notice: Subject to any disclaimer, the term of this patent is extended or adjusted under 35 U.S.C. 154(b) by 0 days.

(21) Appl. No.: 09/355,418

(22) PCT Filed: Jan. 30, 1998

(86) PCT No.: PCT/JP98/00385

§ 371 Date: Sep. 17, 1999

§ 102(e) Date: Sep. 17, 1999

(30) Foreign Application Priority Data

Jan. 31, 1997 (JP) ..... 9-000374
Mar. 27, 1997 (JP) ..... 9-074827

(51) Int. Cl.[7] ..... A44C 7/00
(52) U.S. Cl. ..... 63/12; 63/13
(58) Field of Search ..... 63/12, 13

(56) References Cited

U.S. PATENT DOCUMENTS 262,785 * 8/1882 Jeanne ..... 63/13 X
398,126 * 2/1889 Brooks ..... 63/13
465,830 * 12/1891 Bulova ..... 63/13
483,214 * 9/1892 Gaynor ..... 63/13
790,965 * 5/1905 Lieberfreund ..... 63/12
1,561,128 * 11/1925 Waller ..... 63/12
4,517,816 * 5/1985 Hess ..... 63/12
4,907,424 * 3/1990 Reinstein et al. ..... 63/12
5,025,643 * 6/1991 Chan et al. ..... 63/12
5,161,391 * 11/1992 Lorberfeld ..... 63/13
5,165,258 * 11/1992 Kogen ..... 63/12

FOREIGN PATENT DOCUMENTS 4-14023 3/1992 (JP) .
3022587 3/1996 (JP) .

* cited by examiner

*Primary Examiner*—B. Dayoan
*Assistant Examiner*—Andrea Chop
(74) *Attorney, Agent, or Firm*—Wenderoth, Lind & Ponack, L.L.P.

(57) ABSTRACT

A pierced earring having an earring body with an open space between a top end and another end. The top end is elongated to serve as a pin, which is inserted into a hole in the pierced earlobe. The earring body has the pin in a U-shape design for ornamental purposes, while a shaft base is provided on the bottom end. A clasp is held by a shaft in this shaft base and the tip of the clasp is slipped on the U-shape pin to keep it from falling off. Since this pierced earring makes it impossible for the clasp to be opened easily from the pin of the earring body, it provides a pierced earring which, once it is fixed to the earlobe, will be certain to never slip off the hole in the pierced earlobe. Also, a pierced earring is provided in which the clasp can be easily fixed to or released from the earring body.

4 Claims, 5 Drawing Sheets

PIERCED EARRING

TECHNICAL FIELD

The present invention relates to a pierced earring capable of being easily attached to and detached from an ear lobe while, at the same time, preventing with certainty the earring from falling off the ear lobe.

BACKGROUND OF THE INVENTION

Various devices and constructions have been devised heretofore to keep the pierced earring releasably attached to the earlobe. One known arrangement is described in U.S. Pat. No. 5,025,643, in which a pin is protrudingly set in the back of an earring body of a decorative nature, with the provision of a bearing thereunder to stop a clip with a shaft, the clip being urged to rotate beyond the pin in the direction of the earring body.

Another prior art arrangement to which this invention pertains is found in the Japanese Patent Laid-Open Publication No. HEI 7-289318, in which elasticity is conferred on a ring-shape structure comprising an earring body and a pin protrudingly set in the back of the earring body with a tip thereof bent upward, a hook held by a shaft on the underside of the earring body, and the hook being made to engage on the tip of the pin by pushing the ring-like structure and thus ① contracting the diameter thereof.

However, in the former case of the above-mentioned earring body of the decorative nature, wherein the pin is protrudingly set in the back thereof, the bearing provided on the underside thereof to stop the clip with the shaft, the clip being urged to rotate beyond the pin in the direction of the earring body, when a force to open the clip is applied, the clip simply opens up, thereby making it impossible to stop the clip from slipping off.

Moreover, there is a problem of durability in that the pin set protrudingly in the back of the earring body is fixed by brazing, so that the pin tends to break or bend during use.

In the latter arrangement, wherein elasticity is endowed on the ring-like structure comprising the earring body and the pin with the hook being held by the shaft on the underside of the earring body, the hook being made to engage on the tip of the pin by pressing the ring-like structure and thus ① contracting the diameter thereof, a problem exists the because the material and structure of the earring body provide are thereby self-imposed. Moreover, the need to press the ring-like structure and to contract the diameter thereof makes it difficult to carry out the operation of engaging or disengaging the hook on or from the tip of the pin.

The present invention is directed to eliminating these drawbacks described above and an object of the present invention is to provide a pierced earring which can securely keep the earring from falling off a hole in the pierced ear lobe once it is attached thereto inasmuch as a clasp will not open easily from a pin of the earring body.

Another object of the present invention is to provide a pierced earring which is not subject to any constraint on the material and structure of the earring body, thereby facilitating the attaching and detaching operations of the clasp to or from the earring body.

SUMMARY OF THE INVENTION

The present invention provides a pierced earring which comprises an earring body with an open space between the top end and the other end thereof, the top end being stretched to serve as a pin for insertion into the hole in the pierced earlobe, the pin being formed in a U-shape for ornamentation, and the bottom end of the earring body being provided with a shaft base, to which a clasp is held by the shaft, so that the tip of the clasp is inserted into the above-mentioned U-shape pin to prevent the earring from falling off.

According to the present invention, there is also provided a pierced earring, which comprises an earring body with an open space between the top end and the other end thereof, the top end being stretched to serve as a pin for insertion into the hole in the pierced earlobe, the pin being formed in a U-shape for ornamentation, and the other end of the earring body being provided with a shaft base, to which a clasp is held by the shaft, so that the tip of the clasp is inserted into the above-mentioned U-shape pin to prevent the earring from falling off a depression thereof.

Moreover, the present invention provides a pierced earring, which comprises an earring body with an open space between the top end and the other end thereof, the top end being stretched to serve as a pin for insertion into the hole in the pierced earlobe, the pin being formed in a U-shape for ornamentation, and the other end of the earring body being provided with a shaft base, to which a. clasp is held by the shaft, so that the tip of the clasp can be pressed in from the bottom of the above-mentioned U-shape pin to prevent the earring from slipping off.

DESCRIPTION OF THE BEST MODE EMBODIMENTS

Preferred embodiments of this invention will now be described with reference to the accompanied drawings.

Figure 1:
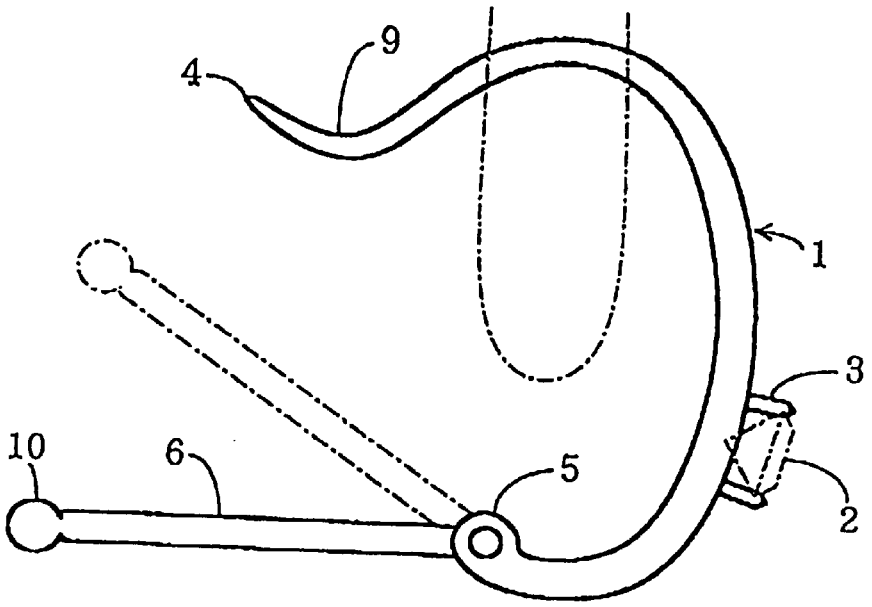
FIG. 1 shows a first embodiment of a pierced earring according to this invention, presenting a side view with a clasp in the open condition.
Figure 2:
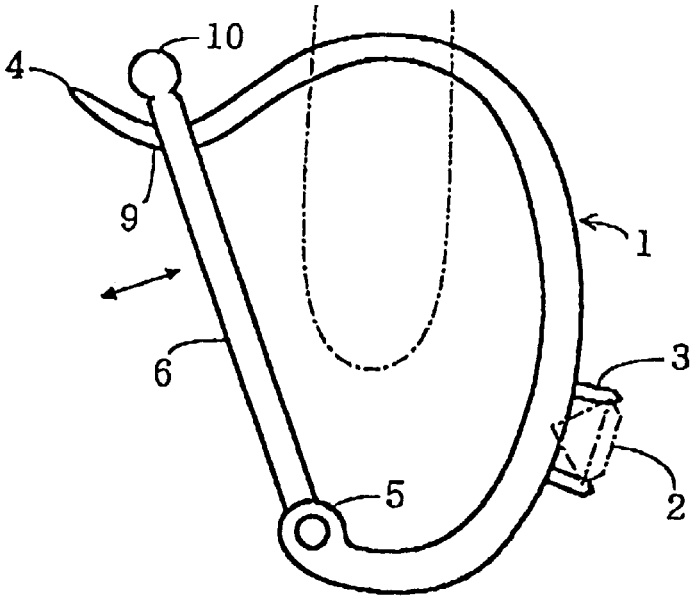
FIG. 2 is a side view with the clasp in the closed condition.
Figure 5:
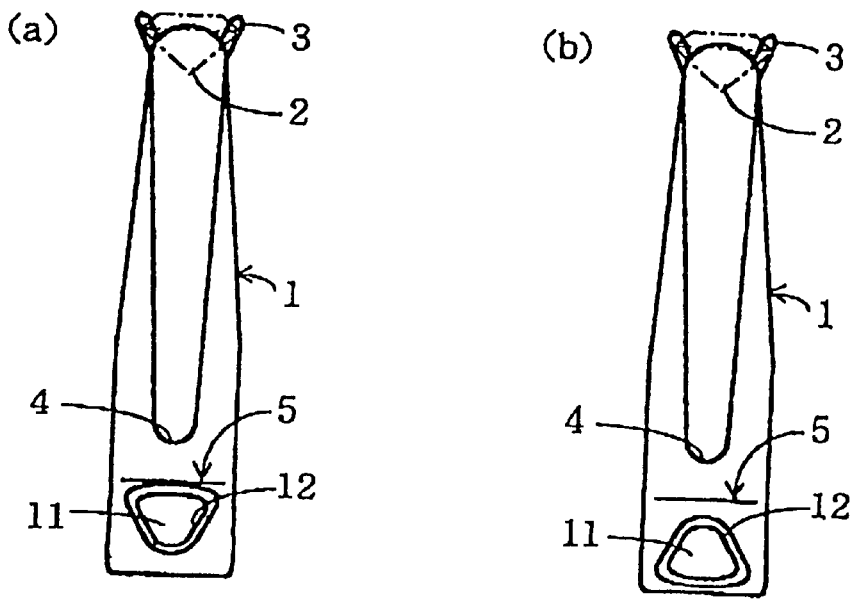
FIG. 5(*a*) is a top view of an earring body with the shaft base having the V-shape incline and (*b*) is a top view of the earring body with the shaft base having the incline broadening toward the end.

Referring to a pierced earring shown in FIG. 1 and FIGS. 5(*a*) and (*b*), 1 is an earring body constructed in a decorative design, and there is provided a plurality of prongs 3 around which a jewel 2 such as a diamond is inserted on a front part of the earring body 1. In this drawing, four prongs are protrudingly set up as an example.

At a top end of the above-mentioned earring body 1 is formed a pin 4 in a U-shape to be inserted into a hole provided in a pierced earlobe, the U-shape pin 4 being arranged with proper thickness and curve to enable effortless insertion thereof into the hole in the pierced earlobe and constructed of the identical material to that of the earring body 1 throughout.

On the other end of the above-mentioned earring body 1 in the back position thereof is provided a shaft base 5 of a clasp 6. In this example, the shaft base 5 has an opening 11 provided with a V-shape incline so that the bottom end of the clasp 6 formed of an elastic material, for example, a precious metal wire, is held by the shaft.

Figure 3:
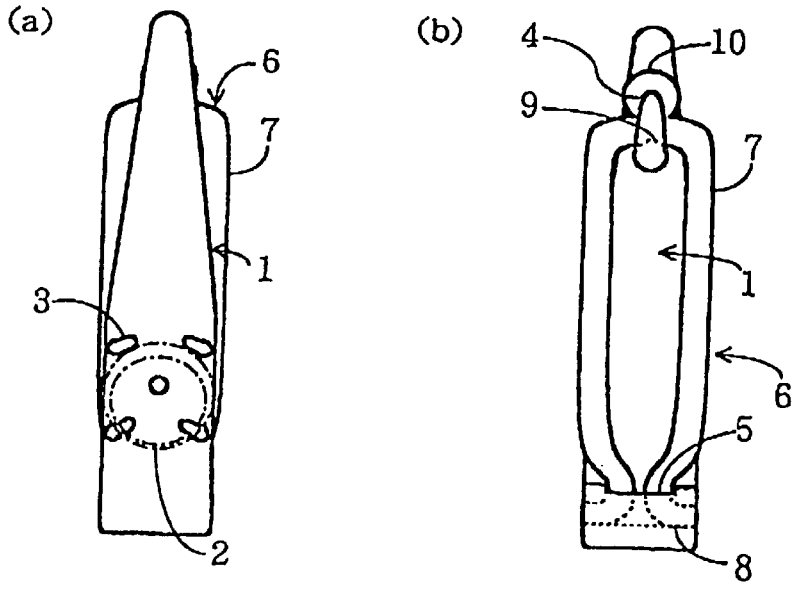
FIG. 3(*a*) is a front elevation with the clasp in the closed condition, and (*b*) is a rear elevation with the clasp in the closed condition.

The clasp 6 is, on the whole, formed of a precious metal wire in the shape of a ring. Referring to FIG. 3(*b*), on the top end of the clasp 6 in the longitudinal direction is provided a diameter expanding part 7, while on a bottom end thereof is provided a shaft 8, the clasp 6 being rotatably mounted on the shaft base 5. The diameter expanding part 7 on a top is adapted to be inserted from the top of the tip of the above-mentioned U-shape pin 4 into a depression 9 thereof, wherein it is prevented from coming off. In FIG. 3(*b*), there is shown a globular knob 10 provided at the tip of the clasp 6.

Figure 4:
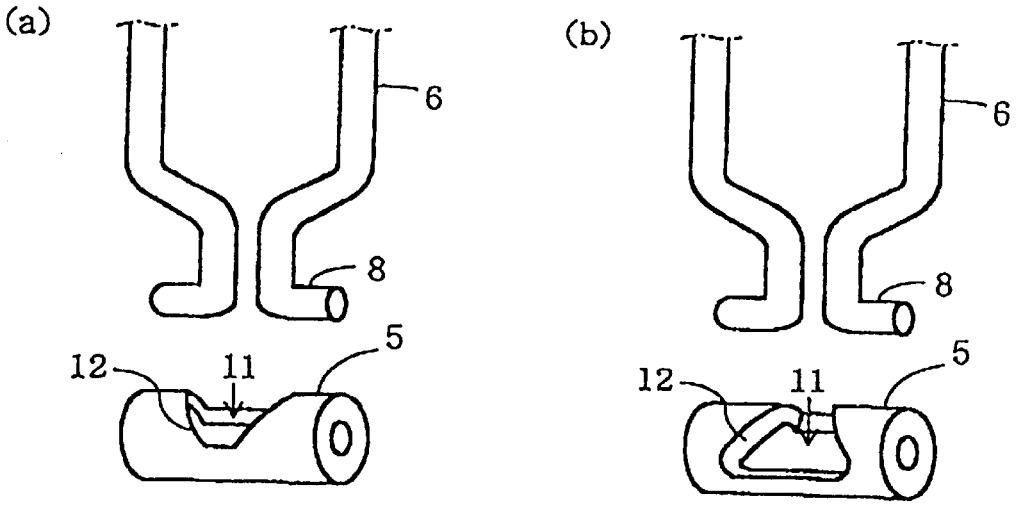
FIG. 4(*a*) is a perspective view of the shaft base provided with a V-shape incline and (*b*) is a perspective view of the shaft base provided with an incline broadening toward the end.

FIGS. 4(*a*) and (*b*) and FIGS. 5(*a*) and (*b*) illustrate examples of the shaft base 5 to be provided at the earring body. In respective examples of FIG. 4(*a*) and FIG. 5(*a*), a V-shape incline 12 urges the clasp 6 in a direction to be inserted in the depression 9, while in respective examples of FIG. 4(*b*) and FIG. 5(*b*), the incline 12 broadening toward the end urges (biases) the clasp 6 in a direction of going over the top end of the pin 4 to be engaged on the tip of the pin 4. Consequently, in the examples of FIG. 4(*a*) and FIG. 5(*a*), the clasp 6 runs against a position beyond the depression 9 of the pin 4, and stops there. In the embodiment of FIG. 4(*b*) and FIG. 5(*b*), after the clasp 6 goes over the top of the pin 4, as one removes one's hand therefrom, the clasp 6 returns in the reverse direction, hits the tip of the pin, and stops there.

Formation of the above-mentioned shaft base 5 may be made by casting the earring body 1, boring at the time of cutting operations, or constructing the earring body 1 with pipe and subjecting it to the specified metalworking procedure.

When using the pierced earring shown in the embodiment of FIG. 4(*a*) and FIG. 5(*a*), while the clasp 6 is first in the open condition against the urging of the V-shape incline 12, the pin 4 provided at the top end of the earring 1 is inserted into the hole punctured in the pierced earlobe. Next, when one releases one's hand, the clasp 6 turns around automatically and the diameter expanding part 7 on the upper side thereof is inserted from the top end of the pin 4 protruding from behind the hole provided in the pierced earlobe. Thereafter, by means of elasticity of the precious metal making up the clasp 6, the diameter expanding part 7 thereof will go over the top (overlap) of the U-shape pin 4 to be held in the condition of being inserted in the depression 9.

Since the clasp 6, when inserted in the depression 9, is not subject to any urging from anywhere, the earlobe is also not subject to any pressing force so as to cause no pain in the earlobe. In addition, because the clasp is subject to urging from the V-shape incline 12, it will not easily slip off the depression 9.

When using the pierced earring shown in the embodiment of FIG. 4(*b*) and FIG. 5(*b*), first the pin 4 provided on the top end of the earring body 1 is inserted into the hole set up in the pierced earlobe. Next, the clasp 6 is closed by pushing in the diameter expanding part 7 on the upper side thereof from the tip of the pin 4 protruding from behind the hole provided in the pierced earlobe. Thereafter, when one releases one's hand, by means of elasticity of the precious metal making up the clasp 6, the clasp 6 turns around automatically in the reverse direction and is held in the condition of being engaged on the inside of the tip of the pin 4.

Since the clasp 6, when engaged on the inside of the tip of the pin 4, is not subject to any urging toward the direction of the earlobe, the earlobe is also not subject to any urging, thus causing no pain in the earlobe. In addition, because the clasp 6 is subject to urging from the above-mentioned incline 12 broadening toward the end, no shaking will occur.

Figure 6:
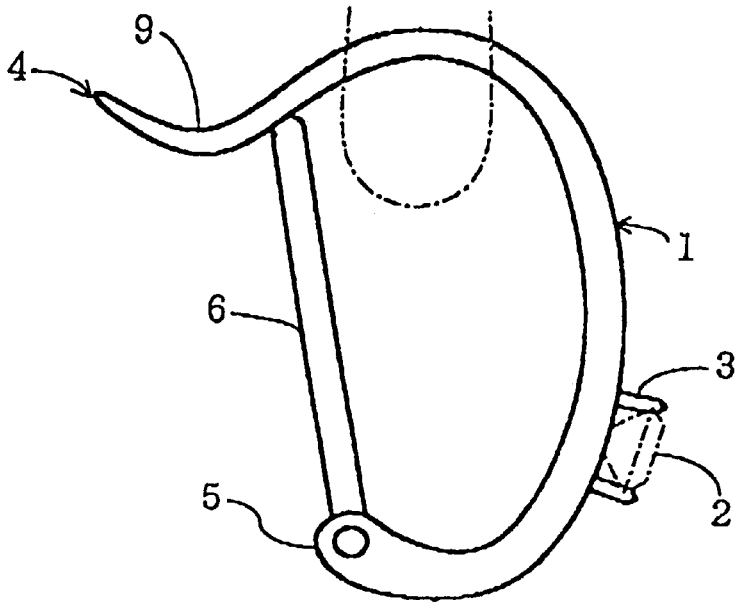
FIG. 6 is a side view of a second embodiment of the pierced earring of this invention.
Figure 9:
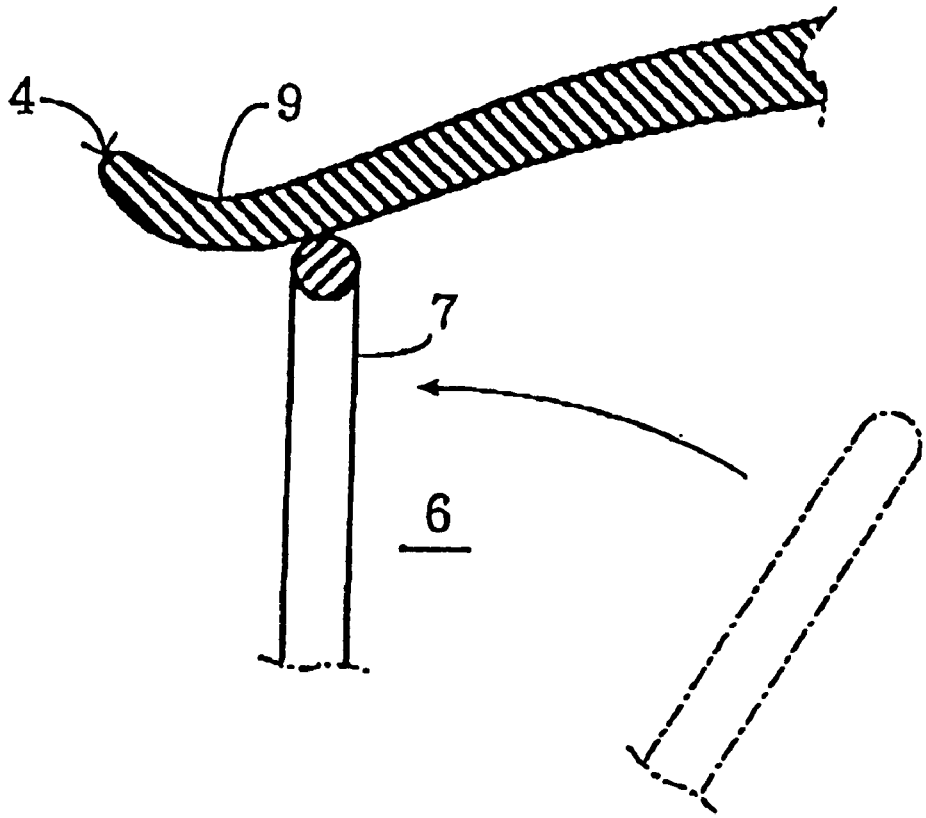
FIG. 9 is a partial sectional view showing a mechanism of the clasp to prevent the earring from slipping off.

FIG. 6 and FIG. 9 show a pierced ring according to a second embodiment of this invention. 1 represents an earring body constructed in a decorative design. On the front part of the earring body 1, there is provided a plurality of prongs 3 for a jewel 2 such as a diamond to be inserted there. In this drawing, four prongs are protrudingly set up as an example.

At the top end of the above-mentioned earring body 1 is likewise formed the pin 4 in U-shape, which is arranged with proper thickness and curve to enable effortless insertion thereof into the hole provided in the pierced earlobe. And the U-shape pin 4 is constructed of the identical material to that of the earring body 1 throughout.

Figure 7:
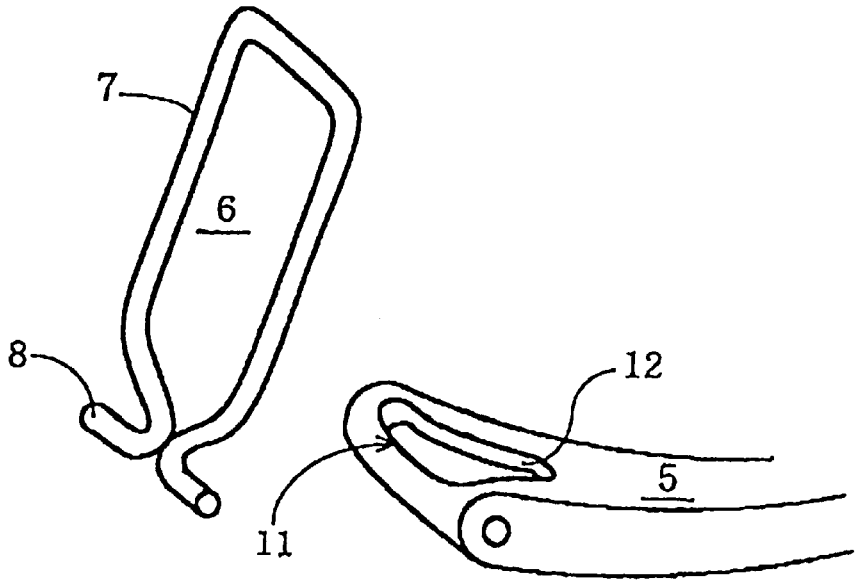
FIG. 7 is a perspective view of a clasp in a disassembled condition.
Figure 8:
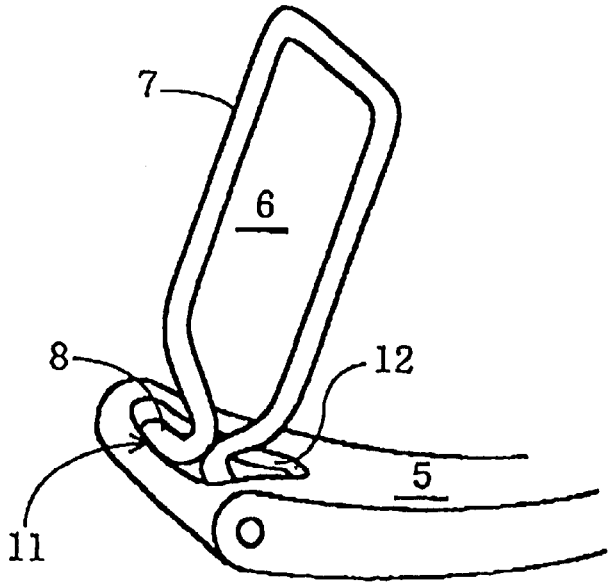
FIG. 8 is a perspective view of the clasp in an attached condition.

On the other end of the above-mentioned earring body 1 in the back position thereof is provided the shaft base 5 of the clasp 6. In this embodiment, the shaft base 5 has the opening 11 provided with an incline broadening toward the end, and as FIG. 7 shows, the bottom end of the clasp 6 formed of an elastic material, for example, a precious metal wire, is held by the shaft. Although the clasp 6 is, at the incline 12 broadening toward the end, being urged to turn toward a wider side, when it further turns around to reach the widest position, the urging force is canceled so that it is effortlessly held at that position.

The clasp 6 is likewise formed of a precious metal wire in the shape of a ring. In the drawing, on the top end thereof in the longitudinal direction is provided the diameter expanding part 7, while on the bottom end thereof is provided the shaft 8 constructed by bending outwardly both ends of the precious metal wire. The clasp 6 is rotatably mounted on the shaft base 5 at the shaft 8. Further, the diameter expanding part 7 on the top is arranged to be inserted beforehand from the bottom of the tip of the above-mentioned U-shape pin 4 so that it is prevented from coming off the inner part of the depression 9.

When using the pierced earring of this embodiment, the pin 4 provided at the top end of the earring body 1 is first inserted into the hole provided in the pierced earlobe. At that instant, the clasp 6 is pushed deeper. Subsequently, in the condition of passing through the earlobe, the clasp 6 is subject to urging at the incline 12 broadening toward the end, turns around automatically, returns to the position in which the top of the diameter expanding part 7 hits the bottom (underside) of the pin 4 protruding from behind the hole provided in the earlobe as shown in FIG. 9, and the clasp 6 is held in the position of being inserted deep in the depression 9.

Since the clasp 6, when inserted deep in the depression 9, is not subject to any urging from anywhere, the earlobe is likewise not subject to any urging, thus causing no pain in the earlobe.

Also, when pulling out the pin 4 from the hole in the pierced earlobe, while pushing the diameter expanding part 7 of the clasp 6 deeper, pull out the pin 4 from the hole in the pierced earlobe.

As is apparent from the foregoing, inasmuch as the clasp cannot be opened easily from the pin of the earring body, the present invention provides a pierced earring which, upon being attached to the earlobe, will in no way slip off the hole in the pierced earlobe.

Furthermore, the present invention imposes absolutely no constraint on the material and structure of the earring body and provides a pierced earring which makes it easy to attach or detach the clasp to or from the earring body.

What is claimed is:

1. A pierced earring comprising:

an earring body having a top end and another end, said top end comprising a pin for insertion through a hole in an ear and said another end comprising a shaft base; and a clasp having a shaft and a diameter expanding part and being hingeably attached to said shaft base via said shaft, wherein said shaft base is operable to normally bias said clasp toward a position such that said diameter expanding part of said clasp overlaps said pin and said shaft base is further operable to hold said diameter expanding part in an overlapping state with respect to said pin, and wherein said shaft base comprises a V-shaped incline, wherein said V-shaped incline is operable to normally bias said clasp such that said diameter expanding part of said clasp overlaps a depression in said top end and said V-shaped incline is further operable to hold said diameter expanding part in an overlapping state with respect to said depression.

2. A pierced earring according to claim 1, wherein said pin is U-shaped.

3. A pierced earring comprising:

an earring body having a top end and another end, said top end comprising a pin for insertion through a hole in an ear and said another end comprising a shaft base; and a clasp having a shaft and a diameter expanding part and being hingeably attached to said shaft base via said shaft, wherein said shaft base is operable to normally bias said clasp toward a position such that said diameter expanding part of said clasp contacts an underside of said pin and said shaft base is further operable to hold said diameter expanding part in contact with said underside of said pin, and wherein said shaft base comprises a V-shaped incline, wherein said V-shaped incline is operable to normally bias said clasp such that said diameter expanding part of said clasp contacts said underside of said pin and said V-shaped incline is further operable to hold said diameter expanding part in contact with said underside of said pin.

4. A pierced earring according to claim 3, wherein said pin is U-shaped.

* * * * *